US006113565A

United States Patent [19]

Schlup et al.

[11] Patent Number: 6,113,565

[45] Date of Patent: Sep. 5, 2000

[54] WRIST BAND WITH RETAINING LANYARD

[76] Inventors: Randy L. Schlup, 56104 Hwy. 50, California, Mo. 65018; Lee Foster, 5310 Sheridan, Jefferson City, Mo. 65109

[21] Appl. No.: 09/017,603

[22] Filed: Feb. 3, 1998

[51] Int. Cl.[7] ..... A61F 13/00; A61F 19/00

[52] U.S. Cl. ..... 602/62; 128/869

[58] Field of Search ..... 602/4, 62–64; 128/846, 877–879, 869; 224/219–222, 267, 922; 473/464, 458, FOR 115; 482/124, 125; 24/3.13

[56] References Cited

U.S. PATENT DOCUMENTS

| | | | |
|---|---|---|---|
| 4,026,549 | 5/1977 | Gunn | 482/124 |
| 4,150,821 | 4/1979 | Racz | 473/464 |
| 4,159,792 | 7/1979 | Siegal | 224/267 |
| 4,728,123 | 3/1988 | Kassal et al. | 280/822 |
| 4,865,239 | 9/1989 | Timbrook | 224/267 |
| 4,962,929 | 10/1990 | Melton, Jr. | 273/29 R |
| 5,052,365 | 10/1991 | Carella | 482/124 X |
| 5,082,156 | 1/1992 | Braun | 224/220 |
| 5,466,215 | 11/1995 | Lair et al. | 602/21 |

*Primary Examiner*—Richard J. Apley
*Assistant Examiner*—Denise Pothier
*Attorney, Agent, or Firm*—Richard J. Grundstrom

[57] ABSTRACT

The wrist band with retaining lanyard of this invention is a wrist band and a retaining lanyard specifically attached to the inside of the wrist band. The wrist band is generally an elongated tubular band having an opening for insertion of a hand therethrough. Most commonly, the wrist band will be made with some type of elastic/cotton blended material that will easily stretch over the hand and fit snugly on the wrist. The wrist band also functions as a sweat band for the wrist. The lanyard has a first end, central length and a second end. In one embodiment, a first loop on the first end of the lanyard is circumferentially attached on the inside of the wrist band at a central location. This provision allows the first loop to close about the wrist if tension is applied to the lanyard concurrently with the wrist band being closed. This provides a cushion to the wrist and security from the lanyard slipping off the wrist. A second loop on the second end of the lanyard is closable about an item or object to retain the item or object should it be accidently dropped or released.

14 Claims, 4 Drawing Sheets

WRIST BAND WITH RETAINING LANYARD

BACKGROUND OF THE INVENTION

The present invention relates to a wrist band with retaining lanyard and more particularly to a wrist band that snugly wraps around the wrist with a retaining lanyard specifically attached thereto. The outward end of the lanyard can be secured to an item or object to prevent it being dropped.

In many occupations, sports and other activities the participants hold objects or other items. This can include, but not limited to, a fishing rod for a fisherman, a paint brush for a painter or a racket for someone playing tennis or racquetball. In these various activities, occupations, and others, participants or individuals hold or grip some item, tool, sport equipment or other object. As such, it is always a possibility that the person could lose their grip or drop the item or object. When this happens there are almost always some consequences. If a fisherman drops his fishing rod it could be lost in the water. Rackets could be thrown across the court which could injure the opponent, break the racket, cause damage or loss of the game. A painter on top of a latter could drop a paint brush causing a mess and the need to climb back down to retrieve the brush.

The above uses are only examples of the wide range of uses this invention applies. The main purpose is to provide a means of attaching the object or item to a lanyard which is attached to a wrist band to retain the item or object should it be accidently dropped or if a person looses his grip for what ever reason. Another use would be as a child restraint device with one end attached to the child and the other attached to the adult.

One of the reasons people drop items or other objects is that sweat runs down the arm and wrist into the hand. The sweat makes the handle of the item or object slippery which makes it easier for the item or object to slip from the hand. This invention can also help to eliminate this problem in that the wrist band can be made from a sweat absorbing material. As such, the wrist band also functions as a sweat band.

There has been other attempts to create such devises, but there has been problems. One problem is that the lanyard or cord was specifically designed for one item and it could not be used for other items or other objects. Often the lanyard, once attached, was difficult, if not impossible, to remove the lanyard from the object. The lanyard was often tied in a knot or physically attached to the object. Another problem was the end of the lanyard that attaches to the person. The lanyard would often slip off the wrist due to the looseness of how attached to the person or due to the pull or yank of the dropped object. The item or object would be dropped despite the lanyard. On the other extreme, the lanyard would tighten onto the wrist making it uncomfortable and/or difficult to remove. The present invention overcomes all these problems.

Accordingly, it is an object of the present invention to provide a wrist band with a retaining lanyard that the lanyard is adapted to be easily attached to an item or object and which is also easily removed, yet can be securely attached to the item or object.

Another object of the present invention is to provide an improved wrist band with retaining lanyard that the wrist band is constructed to slip over the hand and onto the wrist and which fits snugly on the wrist.

A further object of the present invention is to provide a wrist band with retaining lanyard that is adapted to tighten onto the wrist in the event an object or item is dropped or a person loses their grip on the item, to substantially increase the likelihood of retaining the item or object being dropped.

Yet another object of the present invention is to provide a wrist band with retaining lanyard in which the lanyard is attached to the wrist band in such a manner that it tightens concurrently with the wrist band to prevent the lanyard for becoming uncomfortable on the wrist, yet it can be easily loosened for removal.

Still another object of the present invention is to provide a wrist band with retaining lanyard that the wrist band may also function as a wrist sweat band to prevent sweat from running down the wrist onto the hand. The wrist band of this invention is preferably made of a material which has elastic properties to snugly fit onto the wrist and yet has sweat absorbing properties.

Another object of the present invention is to provide a wrist band with retaining lanyard that is adapted to be a universal retaining apparatus which can be utilized on a wide range of items or objects. As such, the lanyard is designed to be attached to virtually any hand held item or object.

Yet another object of the present invention is to provide a wrist band with retaining lanyard which is economically produced, so as it can be affordable by the masses of the people.

Another object of the present invention is to provide a wrist band with retaining lanyard which can be easily washed after being soiled or becomes dirty. It has been found that wrist bands become very soiled after use due to sweat and accumulation of dirt. As such material selected in the manufacture of the wrist band and lanyard are selected from material which are washable and yet do not lose their characteristics when washed.

SUMMARY OF THE INVENTION

To accomplish the foregoing and other objects there is provided a wrist band with a retaining lanyard of this invention.

The wrist band with retaining lanyard of this invention basically includes a wrist band and a lanyard attached thereto for retaining objects and items, such as fishing rods, rackets, paint brushes, wrenches, any other sporting equipment and other hand held objects or items.

One end of the lanyard is attached to the wrist band. The lanyard is attached in a specific manner to prevent the wrist band from being pulled off the wrist. The manner in which the lanyard is attached to the wrist band, allows the lanyard to tighten onto the wrist in conjunction with the wrist band. This arrangement provides a comfortable fit on the wrist, even as the lanyard is tightened. The wrist band provides cushing of the lanyard on the wrist. The lanyard is also designed such that it can be easily loosened once tightened.

The lanyard has a closable loop at the outer end specifically designed such that it can be easily attached and secured to an item or object. The loop even though it secures the object or item can be easily loosened to remove the item or object. The loop is placed over and closed on the handle of a fishing pole, tennis racket, handball racket, or any other type of hand held item or object. This prevents the pole, racket or other item or object from being lost or dropped if it accidently dropped or from rackets and items form being accidently thrown during play. This provides a safety feature in that rackets are retained and fishing poles are not lost in the water when accidently dropped.

Generally, the wrist band will be made with some elastic/cotton blended material that will easily stretch over the hand and fit snugly on the wrist. It will also be sweat absorbing such that the wrist band may also function as a sweat band. Logo's or other information may be contained on the wrist band.

These and other objects and features of the present invention will be better understood and appreciated from the following detailed description of the main embodiment thereof, selected for purposes of illustration and shown in the accompanying drawings.

DETAILED DESCRIPTION

Figure 1:
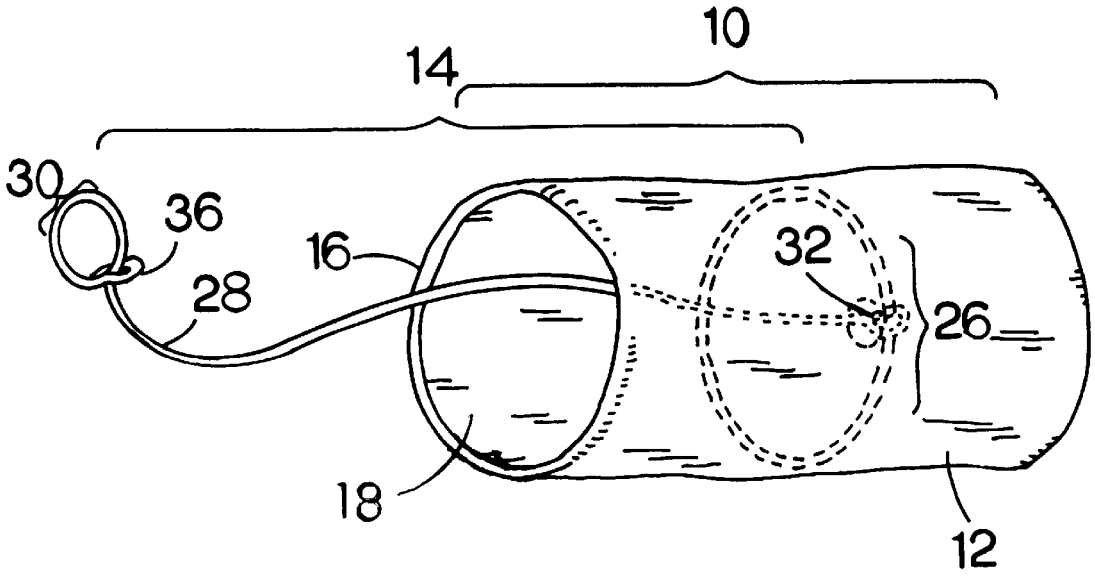
FIG. 1 is a isometric view of the wrist band with retaining lanyard of this invention.

Referring now to the drawings in general there is shown the preferred embodiment for the wrist band with retaining lanyard 10 of this invention. The preferred embodiment and the best mode contemplated of the wrist band with retaining lanyard of the present invention are herein described and illustrated. However, it should be understood that the best mode for carrying out the invention hereinafter described is offered by way of illustration and not by the way of limitation. It is intended that the scope of the invention include all modifications which incorporate its principal design features. Variations are expected from the preferred embodiment as described and illustrated, but other embodiments incorporating the principle features herein disclose and falling within the claims, are considered within the scope and limitations of this invention. The claims are intended to be the limiting factor, not the best mode contemplated as described as the preferred embodiment.

The wrist band with retaining lanyard 10 of this invention generally includes a wrist band 12 and a lanyard 14 attached thereto in a specific manner. The retaining lanyard 14 is for retaining hand held items and objects, such as fishing rods and other sporting equipment, if accidently dropped or released. A secondary use of the wrist band with retaining lanyard 10 of this invention would be as a child restraint. The use of the wrist band with retaining lanyard 10 of this invention is varied and all uses cannot be and are not disclosed herein.

Generally, in the preferred embodiment, the wrist band 12 slips over the hand and onto the wrist. The wrist band 12, in the preferred embodiment will typically be a tubular band made with an elastic/cotton blended material that will easily stretch over the hand and will fit snugly on the wrist. As such, the wrist band 12 is made with a sweat absorbing material such that said wrist band may also function as a sweat band. Logo's or other information may be contained on the wrist band. In a most simple embodiment, the wrist band 12 is a single layer of material.

The wrist band 12 can be a single layer, or in the preferred embodiment, the wrist band 12 contains double layers, outer layer 16 and inner layer 18. The layers 16 and 18 are formed by folding and joining the ends 20 and 22 to form seam 24. The seam 24 may be formed by sewing, but any other suitable means of joining ends 20 and 22 may be utilized without departing from the scope of this invention. Typically, the seam 24 will be turned inward and placed in the center of the wrist band 12. This provides an aesthetical appearance and provides a specific location and means of attaching the lanyard 14, as later described.

The lanyard 14, in a most simple embodiment, has a first end 26 which is simply attached to the inside surface of wrist band 12. In this embodiment the first end 26 is simply attached by sewing or other suitable method of attachment. Typically a length of the lanyard 14 will be used as the first end 26 which is attached. The length will be determined by the size of the wrist band 12, length of the lanyard 14 and the intended use. The length of the first end 26 will be circumferentially attached along the entire length used. This will provide a means of pulling on the wrist band 12 in a manner which will help to prevent the wrist band 12 from slipping off the wrist.

The lanyard 14 in the preferred embodiment, has a first end with a first loop 26, central length 28 and a second end having second loop 30. The overall length of lanyard 14 can vary and can be determined by the specific application. The lanyard 14 is typically made with a nylon-cotton blend or other suitable material. The material of the lanyard 14 must be able to form the first and second loops 26 and 30, be strong, flexible and washable.

The first loop 26 can be made in many ways. In one of the preferred methods, the first loop 26 is made by doubling the first end of the lanyard 14 over onto itself and fastening to form a first fixed loop 32. The lanyard 14 is then extended through the first fixed loop 32 forming first loop 26. This provides for a first loop 26 that can be easily opened and closed, which is an important function of the first loop 26. The first fixed loop 32 is sized larger than the lanyard 14 to allow the lanyard 14 to slide easily therethrough without binding.

The first loop 26 of lanyard 14 is attached within the inside of wrist band 12 and slips over the hand and onto the wrist concurrently with wrist band 14. The first loop 26 is a slip loop that will close about the wrist as lanyard 14 is pulled or yanked. The first loop 26 is circumferentially attached on the inside of the wrist band 12 at a central location, such that, as the first loop 26 closes about the wrist, the wrist band 12 is concurrently tightened about the wrist. This arrangement cushions the first loop 26 on the wrist and helps prevents the first loop 26 from slipping over the hand.

In the preferred embodiment, the first loop 26 is positioned circumferentially around and behind seam 24, which places the first loop 26 between layers 16 and 18. The central portion 28 would extend from between the layers 16 and 18 through a small opening through the seam 24. This arrangement provides a means of allowing the first loop 26 to be easily closed while also closing wrist band 14. This places the inside layer 18 of wrist band 12 against the wrist rather than the cord of the first loop 26. This cushions the lanyard and provides comfort to the user. It also provides a secure means of preventing the first loop 26 from slipping over the hand. This is due to the wrist band 12 itself being tightened against the wrist and not the first loop 26 of lanyard 14 by itself.

Figure 2:
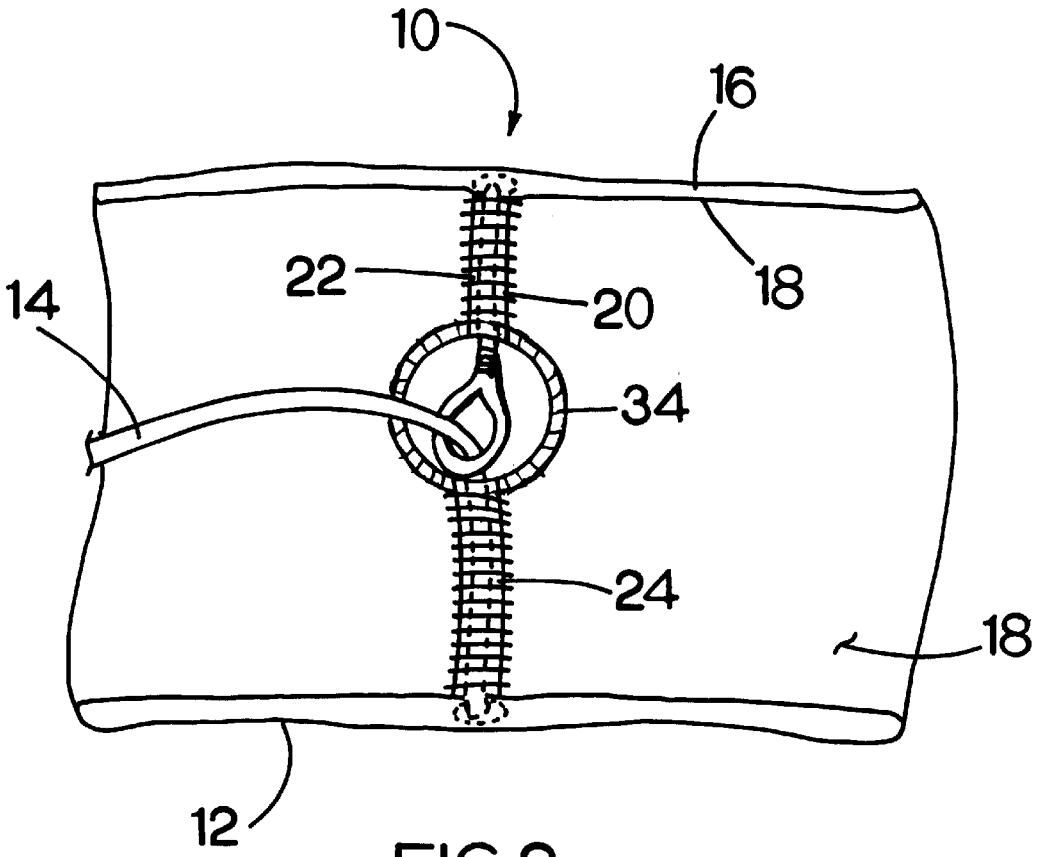
FIG. 2 is a longitudinal cross sectional view of the wrist band with retaining lanyard.
Figure 3:
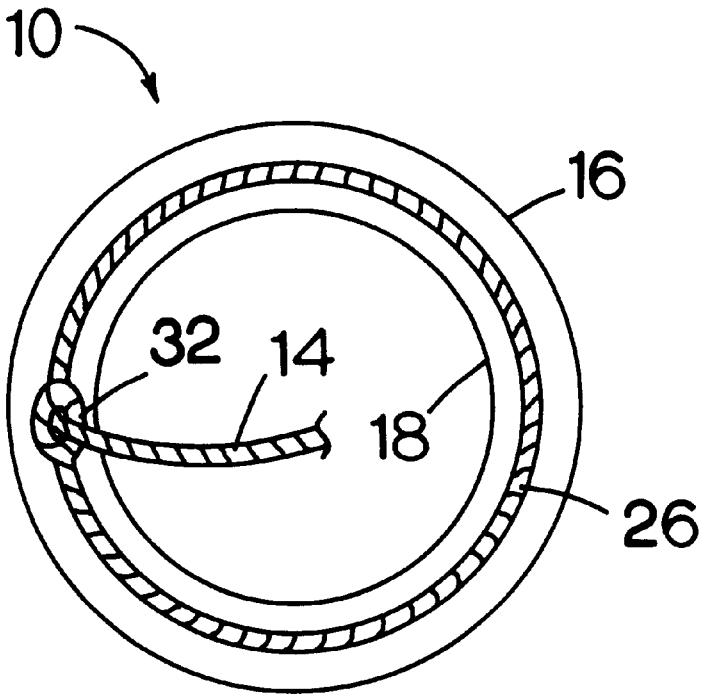
FIG. 3 is a lateral cross sectional view of the wristband with retaining lanyard.
Figure 4:
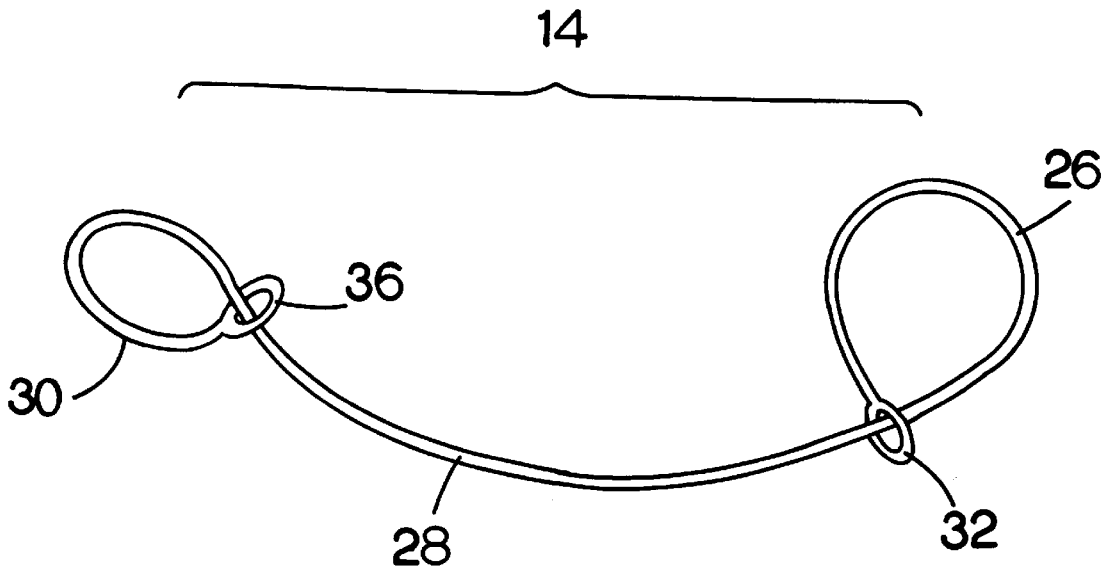
FIG. 4 is a representation of the typical lanyard of this invention.

A slip ring 34 may be used, in another embodiment as shown on FIG. 2, to provide an easy means of making the first loop 26 into a slip loop which is easily opened and closed. The slip ring 34 is a simple nylon or plastic ring of appropriate size. Metal could also be used, but in the preferred embodiment plastic or nylon is preferred. The slip ring 34 prevents binding and allows the loop of the first loop 26 to open and close more easily. The slip ring 34 can be incorporated by any one of several different manners or methods, all of which are not described in detail. Any method or manner, now or later known in the art, of making or incorporating a slip ring 34 to make a slip loop is functionally incorporated herein. The specific manners or method of incorporating a slip ring 34 described herein are for illustrative purposes only and are not meant to be limiting.

In one method, the first end of the lanyard 14 is attached to the slip ring 34, utilizing the methods described above in making the first fixed loop 32. The lanyard 14 is then strung through the slip ring to form the first loop 26. In another method, the slip ring 34 is sewn into the seam 24 to provide an opening. The first end of the lanyard 14 can be attached to the slip ring 32 as just described, or a first fixed loop 32 could be used or to the first end could simple be attached to the inside of seam 24. These method may be used in the alternative or in addition to the first fixed loop 32. The slip ring 34 provides a fixed opening in the seam 24. The lanyard 14 extends through the opening in the slip ring 34 from between layers 16 and 18. The opening in the slip ring 34 provides a fixed opening that will prevent binding of the lanyard 14 as the first loop 26 opens and closes. The first loop 26 is actually located between the outer layer 16 and inner layer 18 in this embodiment.

The central length 28 of lanyard 14 extends from one of the open ends of wrist band 12. The wrist band 12 is placed on the wrist such that the central length 28 extends outward in the direction of the hand.

The second loop 30, located at the second end of the lanyard 14, is similar to the first loop 26 in that it is also a slip loop. However it is designed not to be easily slipped on its own. In the preferred embodiment, the second loop 30 is formed with a second fixed loop 36 and the lanyard 14 extending through the second fixed loop 36. The second fixed loop 36, in the preferred embodiment, is formed by the second end of the lanyard 14 being doubled over and attached to the lanyard 14. The second end can be attached by sewing or by slipping the end into an opening on the lanyard 14. In the latter, as the second fixed loop 36 is pulled the lanyard 14 tightens on the second end to secure the second end within the lanyard 14. The second fixed loop 36 is sized to fit the lanyard 14 snugly therein. The lanyard 14 in the second loop 30 should fit snugly onto the item or object. As such binding of the lanyard within the second fixed loop 36 is generally accepted.

The second fixed loop 36 is also fixed to allow the second loop 30 to be opened to insure the lanyard can be readily removed from the item or object. The lanyard 14 should also be able to slide within the second fixed loop 36 to enlarge the second loop 30 to remove an item or object without undue efforts. Therefore, the second fixed loop 36 is designed to fit snugly about the lanyard 14 such that an item may be snugly secured to the lanyard 14 by the second loop 30, but yet be easily loosened to remove the item or object.

In operation, the wrist band 12, of the wrist band with retaining lanyard 10, is opened to form an elongated tube with an opening therethrough. This widens the first loop 26 contained within the wrist band 12 and provides room to slip the hand through the wrist band 12 and the first loop 26 contained therein. The lanyard 14 is extended through one of the openings on the wrist band 12, such that once installed, the lanyard 14 will extend outward towards the hand. The hand is slipped through the opening in the wrist band 12 and positioned on the wrist. The second loop 30 at the second end of the lanyard 14 is placed over a handle or other portion of an item or object. The second loop 30 is closed onto the item or object by pulling the lanyard 14 through the second fixed loop 36. The wrist band with retaining lanyard 10 is now in use. Should the item or object fall or be dropped the first loop 26 in conjunction with the wristband 12 tightens about the wrist and the item or object is retained.

To remove the wrist band with retaining lanyard 10, the second loop 30 is loosened from the item or object. This is done by pulling the portion of the second loop 30 through the second fixed loop 36 to enlarge the second loop 30. This frees the item or object. The wrist band 12 is then pulled off the wrist and over the hand. If the first loop 26 was tightened at all through the use, pulling off the wrist band 12 also opens or loosens the first loop 26 such that it is also easily removed. The wrist band with retaining lanyard 10 is thus removed and is ready for the next use.

The wrist band with retaining lanyard 10 can be used in many different applications. Retention of fishing poles due to accidental dropping by children is the anticipated first application. It is also being prepared for other sports such as racket ball. However, the wrist band with retaining lanyard 10 can be used with any hand held item or object that has a potential of being accidently dropped or released with the desire to retain the item or object at or near the person. The wrist band with retaining lanyard 10 of this invention can also be used in such an application as a child restraint if the lanyard 14 is made of sufficient length. This disclosure does not state all uses of the wrist band with retaining lanyard 10 of this invention nor does the disclosure limit the use to the uses specifically stated herein. The scope of this invention is by the incorporation of the principle features as claimed and as disclosed herein and not by the uses.

The wrist band with retaining lanyard is made with materials which are also washable, in the preferred embodiment. Since the wrist band with retaining lanyard 10 functions as a sweat band it will become soiled. Also since the wrist band with retaining lanyard is also designed for many applications it may be desirable to wash the apparatus after a use in which it got dirty. Therefore, the material selected to make the wrist band 12 and the lanyard 14 are generally washable. As indicated above, in the preferred embodiment, the wrist band is made with an elastic cotton blended material and the lanyard is made with a nylon cotton blend. Both material are readily washable yet are durable and relatively inexpensive.

Having described the invention in detail, those skilled in the art will appreciate that modifications may be made of the invention without departing from the spirit of the inventive concept herein described.

Therefore, it is not intended that the scope of the invention be limited to the specific and preferred embodiments illustrated and described. Rather, it is intended that the scope of the invention be determined by the appended claims and their equivalents.

What is claimed is:

1. A wrist band with retaining lanyard for retaining items or objects comprising:

a wrist band, said wrist band being an elongated tubular band having an opening for insertion of a hand therethrough and for positioning said wrist band onto a wrist, said wrist band is configured to fit snugly on the wrist;

a lanyard having a first end, central length and a second end, said first end of said lanyard attached to the inside of said wrist band at a central location and extending through said opening in said wrist band;

a first loop is contained on said first end of said lanyard, said first loop being circumferentially attached on the inside of said wrist band at a central location which attaches said lanyard to said wrist band, such that said first loop can close onto the wrist if tension is applied to said lanyard; and a second loop is contained on said second end of said lanyard, said second loop being closable about an item or object to be retained.

2. The wrist band with retaining lanyard as set forth in claim 1 in which said wrist band is made with a sweat absorbing material such that said wrist band functions as a sweat band for the wrist.

3. The wrist band with retaining lanyard as set forth in claim 1 in which said wrist band is a doubled layered band having an inner layer and an outer layer, said first loop on said first end of said lanyard being positioned between said inner and outer layers with said central length of said lanyard extending through an opening at a central location through said inside layer of said double layer band.

4. The wrist band with retaining lanyard as set forth in claim 3 further comprising a slip ring, said slip ring positioned between said double layers and fastened to the inside surface of said inside layer, said first end of said lanyard attached to said slip ring, said slip ring positioned over said central located opening such that said central length of said lanyard extends through said slip ring to provide a first loop which can be easily opened and closed.

5. The wrist band with retaining lanyard as set forth in claim 1 further comprising a slip ring, said slip ring being fastened to the inside of said wrist band at a central location and to said first end of said lanyard, said central length of said lanyard extending through said slip ring to form said first loop.

6. The wrist band with retaining lanyard as set forth in claim 1 in which said first loop comprises a first fixed loop made by It doubling said first end of said lanyard over onto said lanyard and fastening to form said first fixed loop and extending said lanyard through said first fixed loop such that said first loop can be easily opened and closed.

7. The wrist band with retaining lanyard as set forth in claim 1 in which said first loop is made by a slip ring attached to said first end of said lanyard and extending said lanyard through said slip ring to form a first loop that is easily opened and closed.

8. The wrist band with retaining lanyard as set forth in claim 1 in which said second loop is formed with a second fixed loop and said lanyard extending through said second fixed loop, said second fixed loop sized to form snugly about said lanyard such that an item may be snugly secured to said lanyard by said second loop.

9. A wrist band with retaining lanyard comprising:

a wrist band, said wrist band being an elongated tubular band made from an elastic material having an opening for insertion of a hand therethrough, said wrist band being doubled layered having an inside layer and an outer layer, said wrist band being positioned onto a wrist, said wrist band is configured to fit snugly on the wrist;

a lanyard having a first end, central length and a second end, said lanyard attached to the inside of said wrist band at a central location and extending through said opening in said wrist band;

a first loop on said first end of said lanyard, said first loop being circumferentially attached on the inside of said wrist band between said inner layer and outer layer at a central location such that said first loop can close onto the wrist concurrently with said inside layer of said wrist band if tension is applied to said lanyard; and a second loop on said second end of said lanyard, said second loop being closable about an item or object to be retained.

10. The wrist band with retaining lanyard as set forth in claim 9 further comprising a slip ring, said slip ring being attached to said inner layer at a central location, said slip ring having an opening therethrough, said lanyard extending from between said inner layer and said outer layer through said opening on said slip ring.

11. The wrist band with retaining lanyard as set forth in claim 9 in which said first loop comprises a first fixed loop made by doubling said first end of said lanyard over onto said lanyard and fastening to form said first fixed loop and extending said lanyard through said first fixed loop such that said first loop can be easily opened and closed.

12. The wrist band with retaining lanyard as set forth in claim 9 in which said second loop is formed with a second fixed loop and said lanyard extending through said second fixed loop, said second fixed loop sized to form snugly about said lanyard such that an object or item may be snugly secured to said lanyard by said second loop.

13. A Method for retaining items or objects with a wrist band comprising the steps of:

providing a wrist band that is pulled over the hand and which fits snugly about the wrist:

providing a lanyard having a first end, a central length and a second end, with a first loop on said first end and a second loop on said second end;

circumferentially attaching said first loop of said lanyard on the inside of said wrist band such that said first loop and said wrist band can close concurrently when said first loop is closed;

extending said lanyard outward from the inside of said wrist band; and attaching said second loop about an object or item to be retained.

14. A wrist band with retaining lanyard for retaining items or objects comprising:

a wrist band, said wrist band being an elongated tubular band having an opening for insertion of a hand therethrough and for positioning said wrist band onto a wrist, said wrist band is configured to fit snugly on the wrist;

a lanyard having a first end, central length and a second end, said first end of said lanyard circumferentially attached to the inside of said wrist band at a central location and extending through said opening in said wrist band; and a loop contained on said second end of said lanyard, said loop being closable about an item or object to be retained.

* * * * *